US010625835B2

(12) United States Patent
Lin

(10) Patent No.: US 10,625,835 B2
(45) Date of Patent: Apr. 21, 2020

(54) MARINE PROPULSION SYSTEM

(71) Applicant: SOLAS SCIENCE & ENGINEERING CO., LTD., Taichung (TW)

(72) Inventor: Yeun-Junn Lin, Taichung (TW)

(73) Assignee: SOLAS SCIENCE & ENGINEERING CO., LTD., Taichung (TW)

( * ) Notice: Subject to any disclaimer, the term of this patent is extended or adjusted under 35 U.S.C. 154(b) by 0 days.

(21) Appl. No.: 15/835,722

(22) Filed: Dec. 8, 2017

(65) Prior Publication Data

US 2019/0084659 A1 Mar. 21, 2019

(30) Foreign Application Priority Data

Sep. 18, 2017 (TW) ..... 106131948 A

(51) Int. Cl.

| | |
|---|---|
| ***B63H 11/113*** | (2006.01) |
| ***B63H 5/15*** | (2006.01) |
| ***B63H 11/11*** | (2006.01) |
| ***B63H 5/16*** | (2006.01) |
| ***B63H 25/42*** | (2006.01) |
| *B63H 11/01* | (2006.01) |

(52) U.S. Cl.

CPC ..... *B63H 5/15* (2013.01); *B63H 5/165* (2013.01); *B63H 11/11* (2013.01); *B63H 11/113* (2013.01); *B63H 25/42* (2013.01); *B63H 11/01* (2013.01)

(58) Field of Classification Search

CPC ..... B63H 11/11; B63H 11/113

See application file for complete search history.

(56) References Cited

U.S. PATENT DOCUMENTS

| | | | | |
|---|---|---|---|---|
| 5,934,953 | A * | 8/1999 | Kobayashi | B63B 17/0018 440/113 |
| 8,070,539 | B2 * | 12/2011 | Carlson | B63H 11/01 440/46 |
| 9,193,425 | B2 * | 11/2015 | Kaneko | B63H 11/11 |
| 10,133,269 | B2 * | 11/2018 | Forslund | B63H 11/11 |

* cited by examiner

*Primary Examiner* — Andrew Polay

(74) *Attorney, Agent, or Firm* — Muncy, Geissler, Olds & Lowe, PC

(57) ABSTRACT

A marine propulsion system includes a water intake guide block with a flow guide passage, a propulsion device including a housing connected to the water intake guide block and a propeller mounted in the housing, a fixed nozzle connected to the housing of the propulsion device, a swinging nozzle connected to the fixed nozzle and biasable leftward and rightward relative to the fixed nozzle, and a contra type bossing pivotally connected to the fixed nozzle and biasable up and down relative to the fixed nozzle. When rotating the propeller, water is sucked into the flow guide passage and propelled by the propeller to eject backward through the fixed nozzle, and the swinging nozzle is biased leftward/rightward to control leftward/rightward turning of the boat, and the contra type bossing is biased upward/downward to control the pitch angle of the boat and forward/backward movement of the boat.

6 Claims, 8 Drawing Sheets

MARINE PROPULSION SYSTEM

BACKGROUND OF THE INVENTION

1. Field of the Invention

The present invention relates to marine technology, and more particularly to a marine propulsion system, which improves boat handling.

2. Description of the Related Art

The general propulsion system of a large boat is mainly controlled to rotate a propeller in creating a water stream and to bias a rudder leftward or rightward, thereby driving the boat forward and control the boat to turn the direction. However, since the propeller and the rudder are located at the bottom side of the boat, it is easy to stir in plastic bags, fishing nets, aquatic plants and other debris during rotation of the propeller, causing damage to the propeller, and may even hurting sea creatures, divers or swimmers.

On the other hand, because the rudder is a plate member located behind the propeller, the predetermined volume of the rudder will inevitably offset some of the thrust of the propeller. When changing the sailing direction of the boat, the rudder must be biased through a large angle so that the board can be effectively turned to the left or right. A boat using this design of conventional propulsion system lacks good handling. More importantly, this conventional design of propulsion system does not have a board retreat mechanism that facilitates flexible control. All these drawbacks still need to be improved.

SUMMARY OF THE INVENTION

The present invention has been accomplished under the circumstances in view. It is the main object of the present invention to provide a marine propulsion system, which greatly enhances the handling and safety of the boat.

To achieve this and other objects of the present invention, a marine propulsion system comprises a water intake guide block, a propeller and a nozzle unit. The water intake guide block defines therein a flow guide passage for guiding a water flow to pass therethrough. The propeller comprises a housing and a propeller. The housing has the front end thereof connected to the water intake guide block. The propeller is rotatably mounted in the housing. During rotation of the propeller, water is sucked into the flow guide passage of the water intake guide block. The nozzle unit comprises a fixed nozzle and a winging nozzle. The fixed nozzle has the front end thereof connected to the rear end of the housing of the propeller so that the fixed nozzle can eject the water stream propelled by the propeller toward the rear side. The swinging nozzle is pivotally coupled to the rear end of the fixed nozzle, and drivable by a first drive source to bias leftwards or rightwards relative to the fixed nozzle. By means of leftward and rightward biasing of the swinging nozzle, the high-speed water flow ejected out of the fixed nozzle can be further ejected out of the swinging nozzle for driving the boat to turn the direction, enhancing the flexibility of the handling of the boat.

Preferably, the marine propulsion system further comprises a contra type bossing pivotally connected to the fixed nozzle. When the boat moves forwards, the contra type bossing is disposed above the swinging nozzle. When the contra type bossing is shifted to the rear side of the swinging nozzle, the water stream ejected by the swinging nozzle is guided by the contra type bossing to eject toward the front side, causing the boat to move backwards. Further, during backward movement of the boat, the swinging nozzle can be synchronously controlled to bias leftwards or rightwards, enabling the water stream passing through the contra type bossing to be concentrated and ejected toward the left front side or right front side to control the backward moving direction of the boat.

Preferably, the water intake guide block further comprises a cleaning access hole located on a top side thereof in communication with the flow guide passage, facilitating removal of garbage, plastic bags, water plants or fishing nets from entering the flow guide passage to damage the propeller. After cleaning, a cover plate is fastened to the water intake guide block to seal the cleaning access hole.

Other advantages and features of the present invention will be fully understood by reference to the following specification in conjunction with the accompanying drawings, in which like reference signs denote like components of structure.

DETAILED DESCRIPTION OF THE INVENTION

The technical contents and features of the present invention will now be described hereinafter with reference to the accompanying drawings. In the specification, the directional terms "front", "back", "left", "right", "inner", "outer", and the like that are mentioned in this specification are merely descriptive terms based on the normal use for directional indication but not intended for use to limit the scope of the invention.

Figure 1:
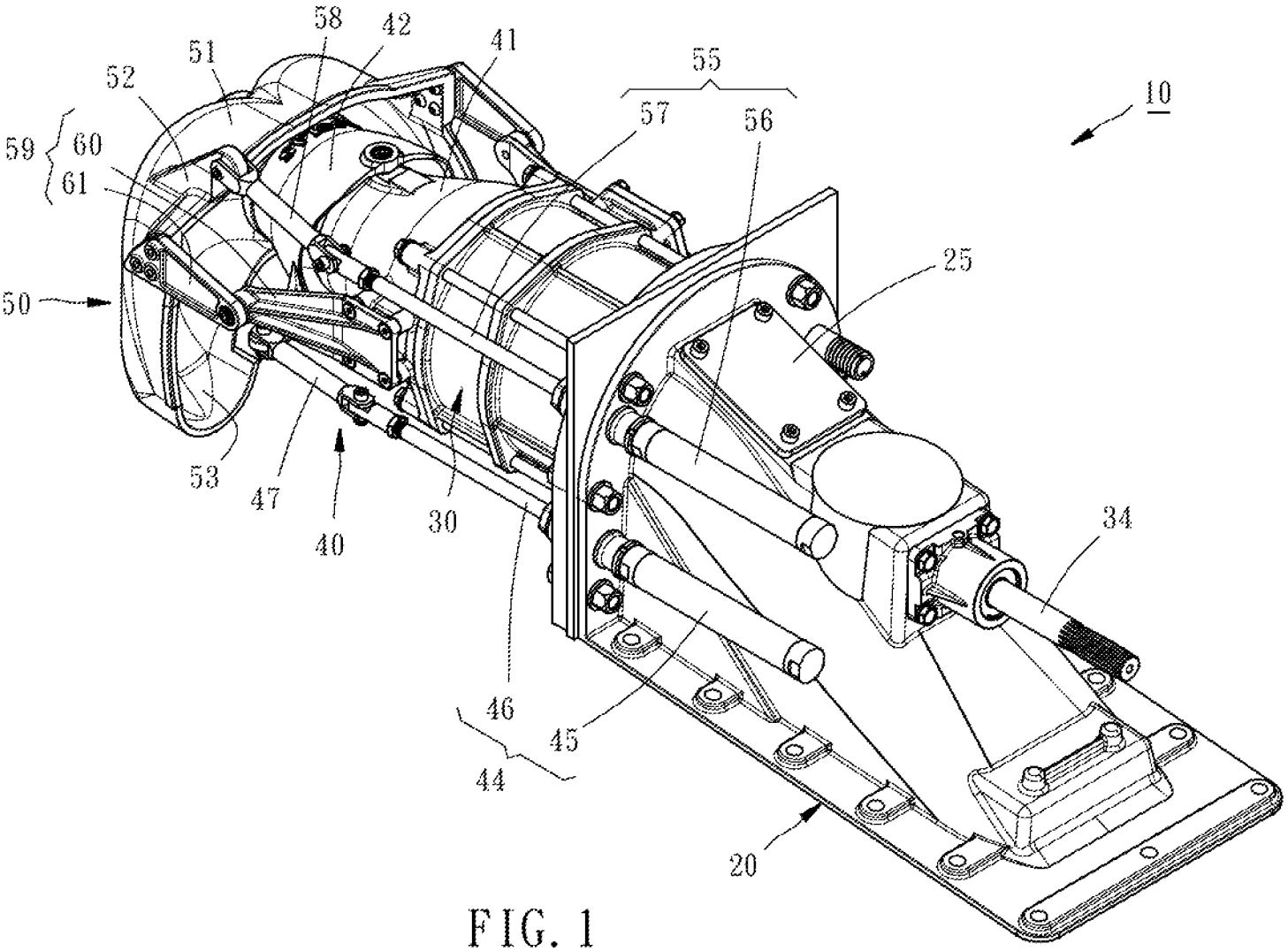
FIG. 1 is an oblique top elevational view of a marine propulsion system in accordance with the present invention.

Referring to FIG. 1, a marine propulsion system 10 in accordance with the present invention is shown. The marine propulsion system 10 comprises a water intake guide block 20, a propulsion device 30, a nozzle unit 40 and a water diversion device set 50.

Figure 2:
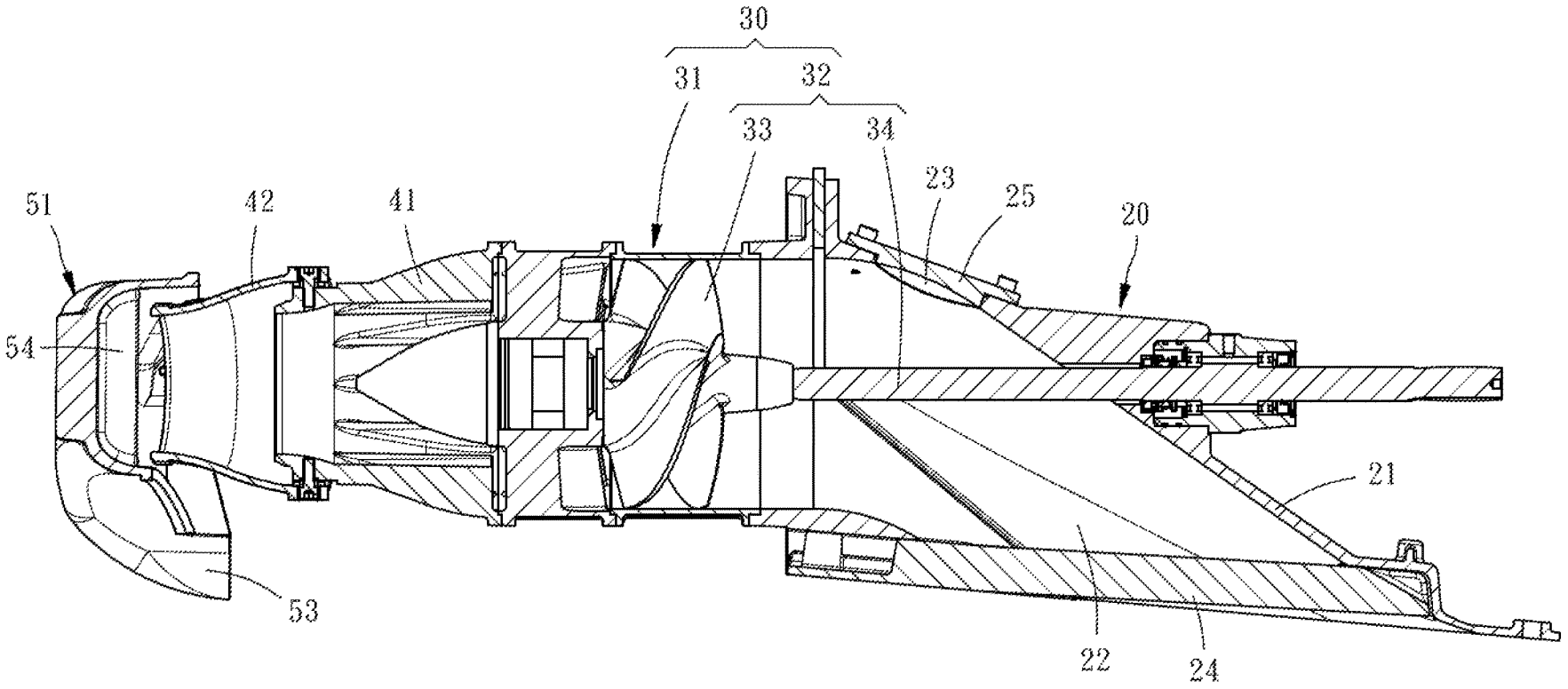
FIG. 2 is a sectional view of the marine propulsion system in accordance with the present invention.
Figure 3:
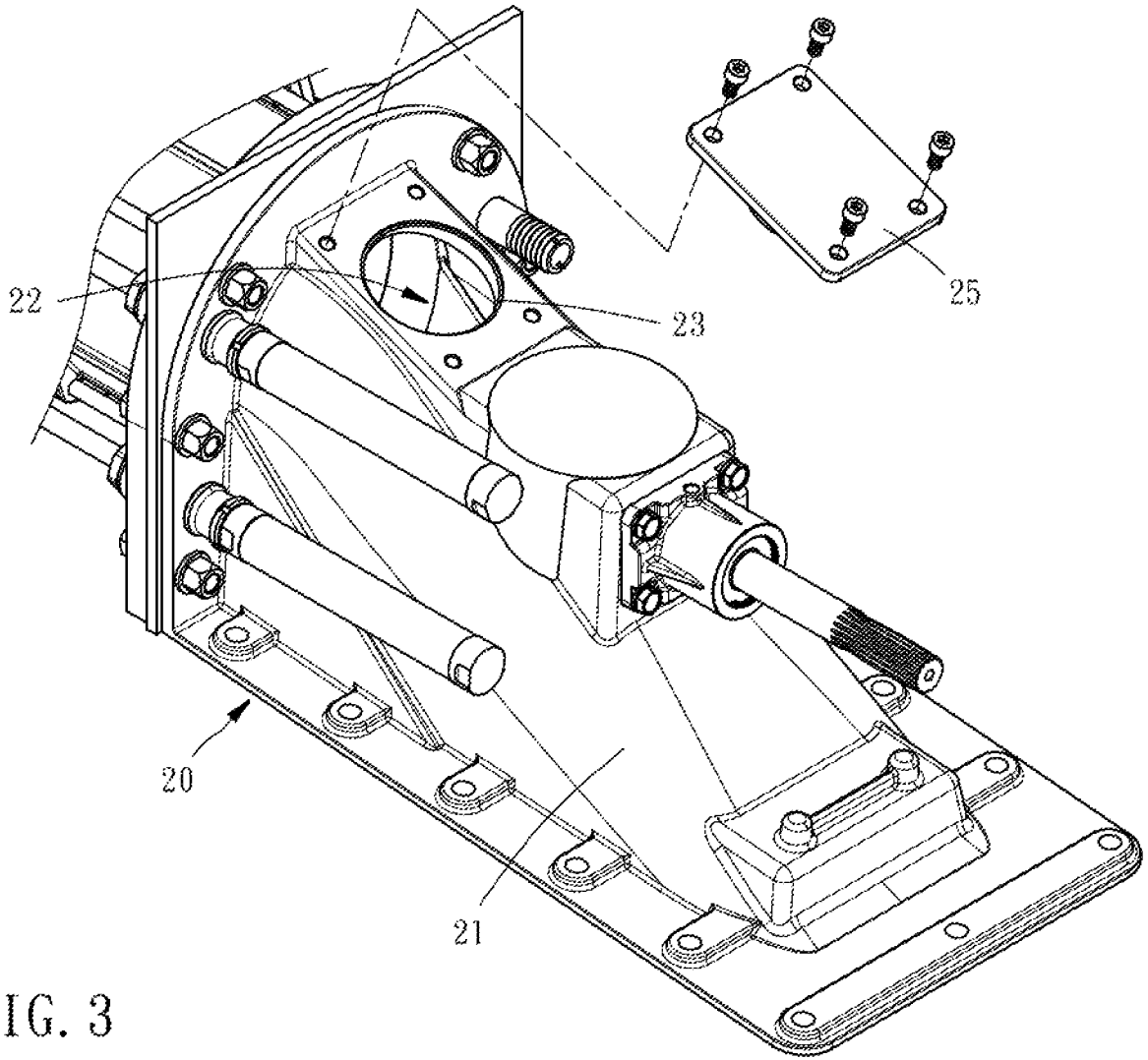
FIG. 3 is an exploded view of a part of the marine propulsion system, illustrating the relationship between the cleaning access hole and the cover plate.

The water intake guide block 20 comprises a block body 21 and an inlet grille 24. The block body 21 is mounted to the stern of a boat (not shown), defining therein a flow guide passage 22 for guiding water to pass therethrough (see FIG. 2 and FIG. 4). The inlet grille 24 is mounted at a bottom side of the block body 21 (see FIG. 2 and FIG. 4) to prevent large debris such as garbage, floats, plastic bags or fishing nets from entering the flow guide passage 22, thereby reducing the chance of large debris entangled in a propeller 32. This propeller 32 will be described latter. Further, the block body 21 comprises a cleaning access hole 23 located on a top side thereof in communication with the flow guide passage 22, as shown in FIGS. 1-3, for allowing cleaning of small debris (such as water plants) that goes through the inlet grille 24 into the flow guide passage 22. After cleaning, a cover plate 25 is locked to the block body 21 to seal the cleaning access hole 23.

The propulsion device 30 comprises a housing 31 and a propeller 32. As illustrated in FIG. 2, the housing 31 has a front end thereof affixed to a rear end of the block body 21 of the water intake guide block 20. The propeller 32 comprises a set of propeller blades 32 and a propeller shaft 34. The propeller shaft 34 is inserted through the block body 21 of the water intake guide block 20, having a front end thereof inserted into the inside of the boat and then connected to a power source (for example, boat engine, not shown) and an opposing rear end thereof inserted into the housing 31 and connected with the propeller blocks 33.

Figure 4:
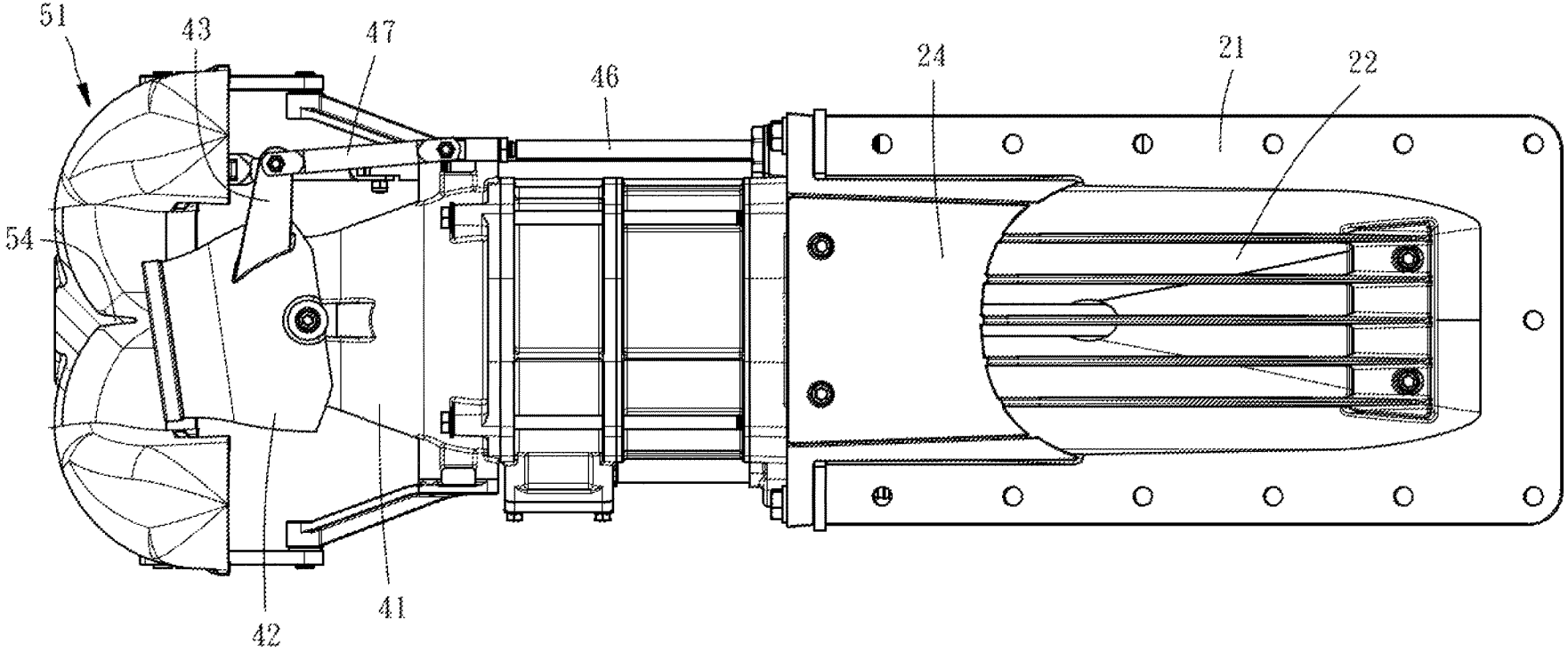
FIG. 4 is a bottom view of the marine propulsion system, illustrating the swinging nozzle biased leftwards.
Figure 5:
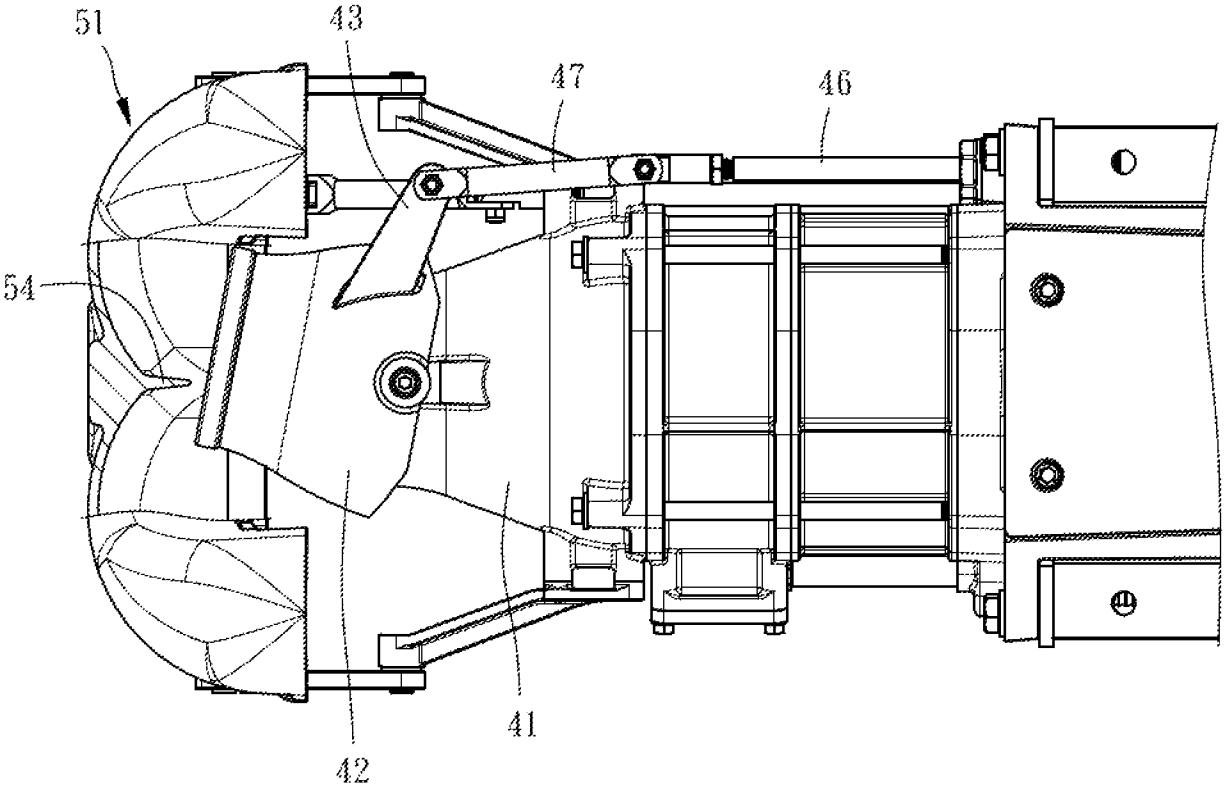
FIG. 5 is similar to FIG. 4, illustrating the swinging nozzle biased rightwards.

The nozzle unit 40 comprises a fixed nozzle 41, a swinging nozzle 42 and a first drive source 44. As illustrated in FIGS. 1 and 2, the fixed nozzle 41 has a front end thereof connected to an opposing rear end of the housing 31 of the propulsion device 30. The swinging nozzle 42 has a front end thereof coupled to an opposing rear end of the fixed nozzle 41, top and bottom edges of the front end respectively and pivotally connected to top and bottom edges of the rear end of the fixed nozzle 41. Further, as illustrated in FIGS. 1, 4 and 5, the swinging nozzle 42 comprises a wing 43 horizontally outwardly extended from an outer perimeter thereof. The first drive source 44 comprises a first fluid cylinder 45 and a first piston rod 46. The first fluid cylinder 45 is mounted to the rear end of the block body 21 of the water intake guide block 20. The first piston rod 46 is reciprocatably mounted in the first fluid cylinder 45 with a rear end thereof pivotally connected to a front end of a first link 47. The first link 47 has an opposing rear end thereof pivotally connected to the wing 43 of the swinging nozzle 42. Thus, when the first piston rod 46 is being extended out of moved back, the first link 47 is forced to push or pull the wing 43 of the swinging nozzle 42, biasing the swinging nozzle 42 leftward or rightward relative to the fixed nozzle 41.

Figure 6:
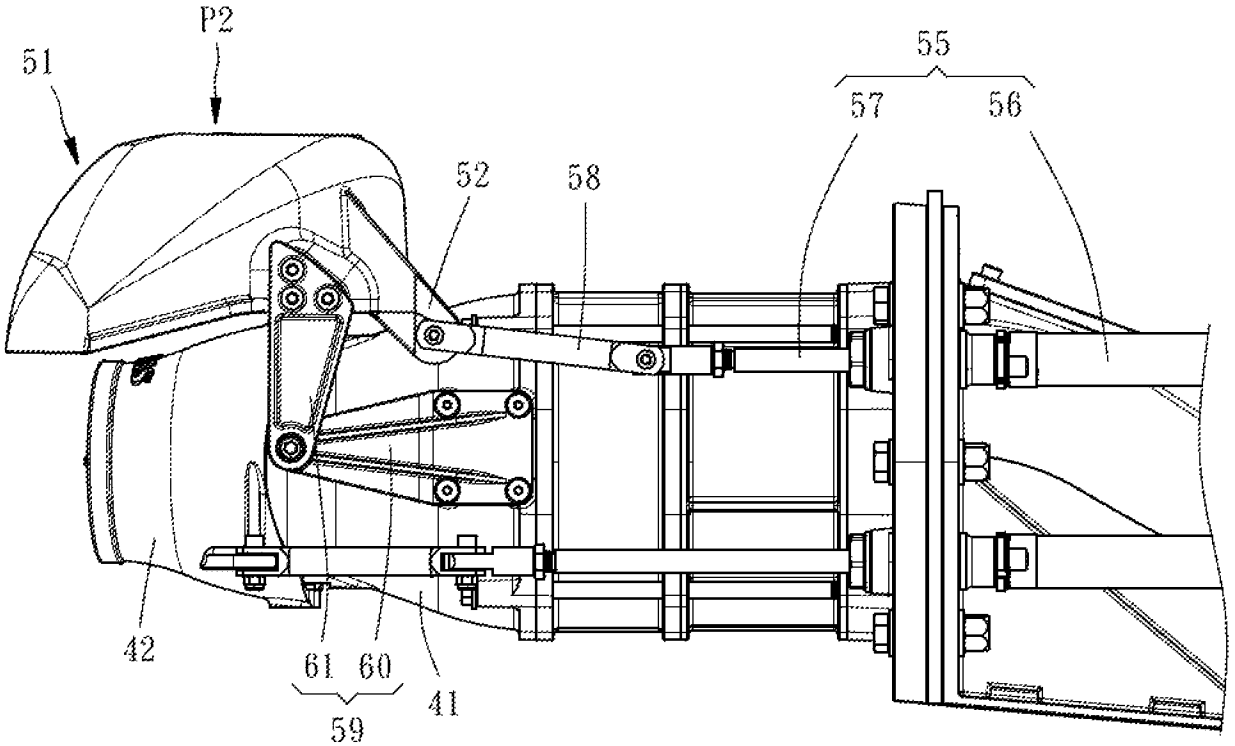
FIG. 6 is a side view of the marine propulsion system, illustrating the contra type bossing disposed above the swinging nozzle.
Figure 7:
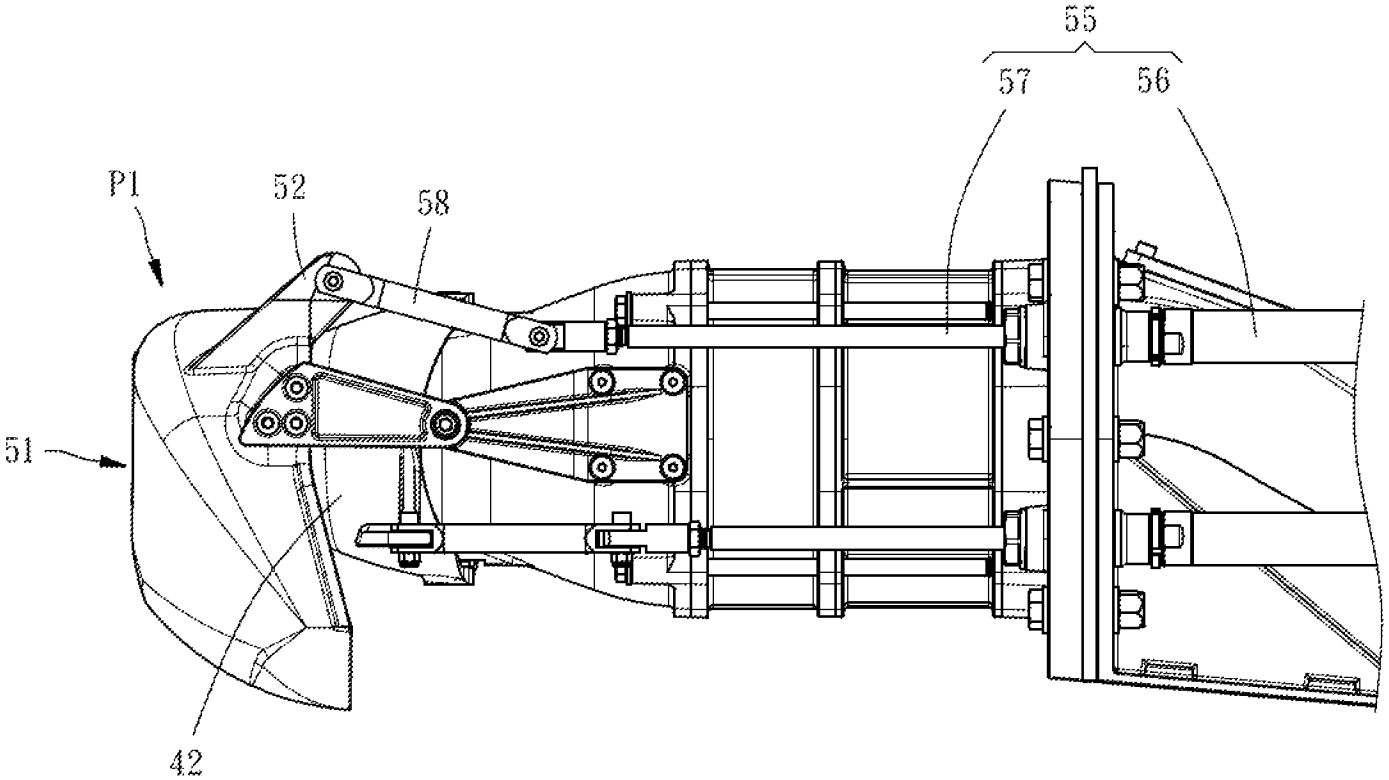
FIG. 7 is similar to FIG. 6, illustrating the contra type bossing disposed at the rear side relative to the swinging nozzle.

The water diversion device set 50 comprises a contra type bossing 51 and a second drive source 55. As illustrated in FIGS. 1 and 6, the contra type bossing 51 is pivotally connected to an outer perimeter of the fixed nozzle 41 by a pair of support frames 59. Each support frame 59 comprises a first support member 60, and a second support member 61 pivotally connected to the first support member 60. The first support member 60 has one end thereof pivotally connected to the outer perimeter of the fixed nozzle 41. The second support member 61 has one end thereof connected to an outer perimeter of one end of the contra type bossing 51. Further, as illustrated in FIGS. 1, 6 and 7, the contra type bossing 51 comprises a lug 52 located at a top edge of one end thereof. The second drive source 55 comprises a second fluid cylinder 56 and a second piston rod 57. The second fluid cylinder 56 is mounted to the rear end of the block body 21 of the water intake guide block 20. The second piston rod 57 is reciprocatably mounted in the second fluid cylinder 56, having a rear end thereof pivotally connected to a front end of a second link 58. The second link 58 has an opposing rear end thereof pivotally connected to the lug 52 of the contra type bossing 51. Thus, when the second piston rod 57 is being extended out or moved back, the second link 58 is forced to push or pull the lug 52 of the contra type bossing 51, biasing the contra type bossing 51 upward or downward relative to the swinging nozzle 42 between a first position P1 (i.e., rear side position) and a second position P2 (i.e., top side position). When the contra type bossing 51 reaches the first position P1 shown in FIG. 7, the contra type bossing 51 is disposed in the direction of the extension of the swinging nozzle 42, at this time, the high-speed water flow caused by the propeller 32 is forced by the contra type bossing 51 to eject toward the front side, causing the boat to move backwards. On the contrary, when the contra type bossing 51 reaches the second position P2 shown in FIG. 6, the contra type bossing 51 is moved out of the direction of the extension of swinging nozzle 42 and disposed above the swinging nozzle 42, at this time, the high-speed water flow caused by the propeller 32 is directly ejected toward the rear side of the boat, causing the boat to move forwards.

As illustrated in FIGS. 1 and 2, the contra type bossing 51 further comprises a water guide hole 53 located at each of the two opposite ends thereof and respectively curving toward the propulsion device 30, and a baffle 54 located on the middle of an inner side thereof. As illustrated in FIGS. 2, 4 and 5, when the contra type bossing 51 is in the first position P1, the water flow ejected by swinging nozzle 42 toward the contra type bossing 51 is proportionally divided by the baffle 54 and steadily delivered forward through the two water guide holes 53, significantly enhancing the flexibility of the boat during its backward movement.

As can be seen from the above structure, when the power of the boat is started up to rotate the propeller 32, the water flow at the bottom of the boat is sucked into the flow guide passage 22 of the water intake guide block 20 by the rotation of the propeller 32, and then propelled by the propeller 32 to eject out of the rear side of the boat through the fixed nozzle 41 and the swinging nozzle 42, causing the boat to move forward.

When the boat is to be controlled to turn to the left or to the right, as shown in FIGS. 4 and 5, control the first drive source 44 to bias the swinging nozzle 42 leftward or rightward so that the water flow ejected out of the swinging nozzle 42 is ejected toward the rear right side or rear left side of the boat, causing the boat to turn left or right.

Figure 8:
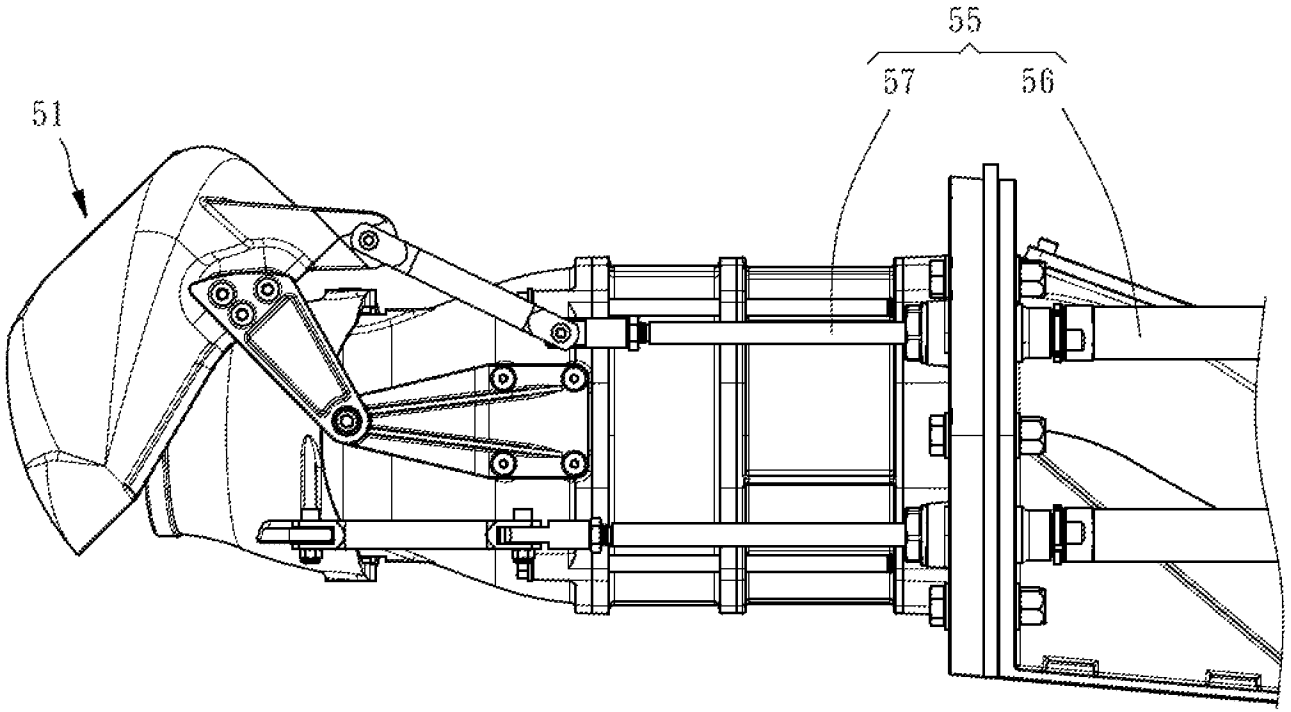
FIG. 8 is similar to FIG. 6, illustrating the contra type bossing biased upwards.

If the draft of the stern of the boat is too deep or too shallow because of the weight and placement of the load, at this time, as illustrated in FIG. 8, control the second drive source 55 to bias the contra type bossing 51 upward or downward to adjust the pitch of the bow of the boat when the boat sailing please refer to FIG. 8, when the boat can be pushed through the second drive source 55 contra type bossing 51 up and down when the boat due to the weight and placement of the load caused by stern Pendulum, used to adjust the pitch when the boat is sailing, so that the boat can maintain the minimum resistance and keep moving forward.

Finally, when the boat is to be controlled backwards, as shown in FIGS. 2 and 7, the boat can control the second drive source 55 to bias the contra type bossing 51 from the second position P2 (i.e., the top side position) to the first position P1 (i.e., the rear side position), so that contra type bossing 51 can be located in the direction of the extension of the swinging nozzle 42, thus, when the water flow is ejected out of the swinging nozzle 42 toward the rear side of the boat, it is equally divided by the baffle 54 of the contra type bossing 51 into the two water guide holes 53 of the contra type bossing 51 and then ejected out of the two water guide holes 53 toward the stern of the boat, causing the boat to move backwards. Moreover, in the process of retreat of the boat, the swinging nozzle 42 can be controlled to bias leftward or rightward, so that the boat can be propelled to move in the rear left or rear right direction.

In summary, the marine propulsion system 10 of the present invention has the following features:

1. The propeller 32 of the marine propulsion system 10 keeps the propeller blades 33 from sight. The design of the inlet grille 24 prevents large debris from being entangled in a propeller 32 when the boat is sailing. Even if small debris is inhaled, it can be cleared through the cleaning access hole 23. In addition, when the boat is docked, the contra type bossing 51 can be put down to form a protective cover, avoiding water-borne creatures or dive personnel from being injured by the propeller 32.
2. The marine propulsion system 10 of the present invention can concentrate the water flow to form a jet stream and to eject it via the swinging nozzle 42, increasing the propulsion efficiency and enhancing the manipulation flexibility of the forward and backward movement of the boat.
3. The marine propulsion system 10 of the present invention can adjust the stern of the boat to the most appropriate pitch angle by means of biasing the contra type bossing 51 upward or downward, avoiding the influence of the forward speed due to excessive navigational resistance. In other words, the marine propulsion system 10 of the present invention can select the pitch of the minimum resistance to navigate.

What is claimed is:

1. A marine propulsion system, comprising:

a water intake guide block comprising a flow guide passage;

a propulsion device comprising a housing and a propeller, said housing having a front end thereof connected to said water intake guide block, said propeller being rotatably mounted in said housing;

a first drive source;

a nozzle unit comprising a fixed nozzle and a swinging nozzle, said fixed nozzle having a front end thereof connected to an opposing rear end of said housing, said swinging nozzle being pivotally coupled to an opposing rear end of said fixed nozzle and drivable by said first drive source to bias leftward or rightward relative to said fixed nozzle;

a second drive source; and a reverse bucket comprising two water guide holes respectively located at two opposite ends thereof and respectively curving toward said propulsion device, said reverse bucket being pivotally connected to an outer perimeter of said fixed nozzle and drivable by said second drive source to bias up and down relative to said swinging nozzle between a first position where said reverse bucket is disposed in the direction of extension of said swinging nozzle and a second position where said bossing is disposed out of the direction of extension of said swinging nozzle, wherein said reverse bucket comprises a lug located at a top edge of one end thereof, and wherein said second drive source comprises:

a second fluid cylinder mounted to said water intake guide block;

a second piston rod reciprocatably mounted in said second fluid cylinder and having a rear end thereof pivotally connected to said second link; and a second link having a front end thereof pivotally connected to the rear end of said second piston rod and serving as a first pivot point, and an opposing rear end thereof pivotally connected to said lug of said reverse bucket and serving as a second pivot point, wherein when the second piston rod is operated to extend and retract reciprocatingly, the second link swing about the first pivot point up and down.

2. The marine propulsion system as claimed in claim 1, wherein said water intake guide block comprises a block body and a cover plate, said block body comprising a flow guide passage therein and a cleaning access hole located in a top side thereof in communication with said flow guide passage, said cover plate being detachably mounted at the top side of said block body to seal said cleaning access hole.

3. The marine propulsion system as claimed in claim 1, wherein said bossing comprises a baffle disposed on the inside thereof on the middle.

4. The marine propulsion system as claimed in claim 1, wherein said swinging nozzle comprises a wing located at an outer perimeter thereof; said first drive source comprises a first fluid cylinder, a first piston rod and a first link, said first fluid cylinder being mounted to said water intake guide block, said first piston rod being reciprocatably mounted in said first fluid cylinder and having a rear end thereof pivotally connected to said first link, said first link having a front end thereof pivotally connected to the rear end of said first piston rod and an opposing rear end thereof pivotally connected to said wing of said swinging nozzle.

5. The marine propulsion system as claimed in claim 1, wherein said water intake guide block comprises a block body and an inlet grille, said block body having said flow guide passage defined therein, said inlet grille being mounted to a bottom side of said block body.

6. The marine propulsion system as claimed in claim 1, further comprising a pair of support frames pivotally connecting said bossing to said fixed nozzle, each said support frame comprising a first support member and a second support member, said first support member having one end thereof pivotally connected to an outer perimeter of said fixed nozzle, said second support member having one end thereof pivotally connected to an opposite end of said first support member and an opposite end thereof pivotally connected to an outer perimeter of said bossing.

* * * * *